US005101590A

United States Patent [19]

Hawkins

[11] Patent Number: 5,101,590

[45] Date of Patent: Apr. 7, 1992

[54] MOUNTING ASSEMBLY

[75] Inventor: Joseph C. Hawkins, Wokingham, England

[73] Assignee: British Aerospace Public Limited Company, London, England

[21] Appl. No.: 530,860

[22] Filed: May 30, 1990

[30] Foreign Application Priority Data

Jun. 16, 1989 [GB] United Kingdom ..... 8913940

[51] Int. Cl.[5] ..... F41G 11/00

[52] U.S. Cl. ..... 42/101; 33/248; 33/250

[58] Field of Search ..... 33/248, 250; 42/101

[56] References Cited

U.S. PATENT DOCUMENTS

| | | | |
|---|---|---|---|
| 1,264,133 | 4/1918 | Morris | 42/101 |
| 1,501,211 | 7/1924 | Forin | 33/250 |
| 2,585,985 | 2/1952 | Anderson | 42/101 |
| 3,476,349 | 11/1969 | Smith | 33/250 |
| 4,409,738 | 10/1983 | Renander et al. | 33/248 |

FOREIGN PATENT DOCUMENTS

| | | |
|---|---|---|
| 0303585 | 2/1989 | European Pat. Off. . |
| 3241753 | 5/1984 | Fed. Rep. of Germany . |
| 3316835 | 11/1984 | Fed. Rep. of Germany . |
| 265676 | 3/1989 | German Democratic Rep. . |

*Primary Examiner*—Richard W. Wendtland
*Attorney, Agent, or Firm*—Cushman, Darby & Cushman

[57] ABSTRACT

A mounting assembly for mounting an item such as a target sensor onto a weapon. The mounting assembly involves a fixing member for fixing the support member to a weapon. A first pivot joint couples the item to the support member to permit turning movement of the item relative to the support member. A second pivot joint couples a lever to the support member to permit turning movement of the lever relative to the support member. A third pivot joint the couples the item to the lever so that turning movement of the lever can be accompanied by turning movement of the item.

6 Claims, 2 Drawing Sheets

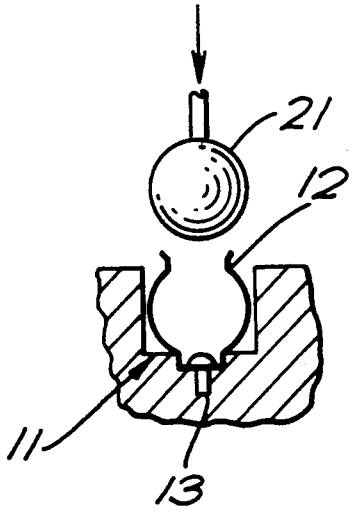
FIG. 2
FIG. 3
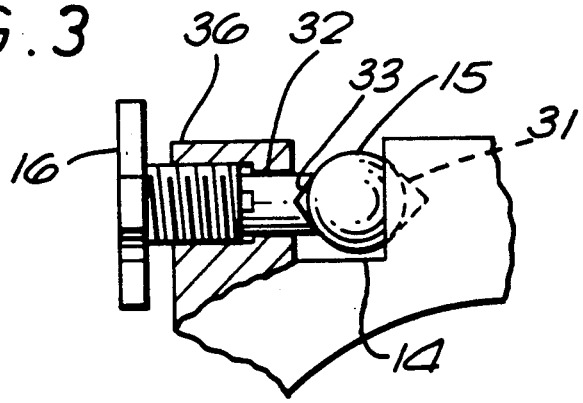
FIG. 4
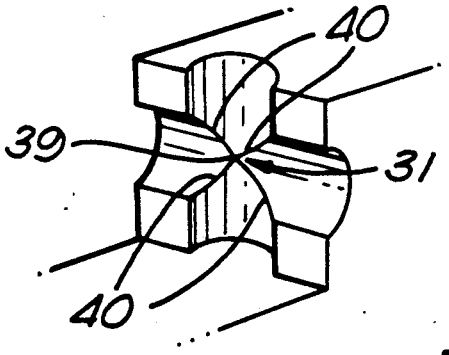
FIG. 5
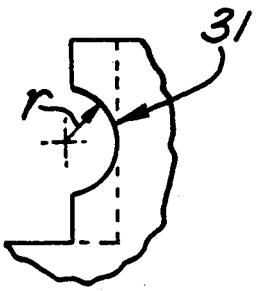

MOUNTING ASSEMBLY

FIELD OF THE INVENTION

This invention relates to a mounting assembly, for mounting an item such as a target sensor onto a weapon.

SUMMARY OF THE INVENTION

According to the present invention there is provided a mounting assembly for mounting an item such as a target sensor onto a weapon, the mounting assembly comprising:

support means;

fixing means for fixing the support means to the weapon;

first pivot joint means for coupling the item to the support means to permit turning movement of the item relative to the support means;

a lever coupled to the support means by way of second pivot joint means for permitting turning movement of the lever relative to the support means; and third pivot joint means for coupling the item to the lever for said turning movement of the lever to be accompanied by said turning movement of the item.

It is preferred that the mounting assembly includes disengageable clamp means for engaging the second pivot joint means to lock the lever and therby also the item against said turning movements thereof.

Preferably each of said pivot joint means comprises ball and socket joint means for permitting turning movement of the item and the lever about respective associated pairs of transverse axes and for causing turning movement of the lever about either one of the pair of axes associated therewith to be accompanied by turning movement of the item about a corresponding parallel one of the pair of axes associated with the item.

Advantageously the first and third pivot joint means each comprise a ball member and a socket formed by one or more spring clips, for example tool clips, for disengageably holding the ball member.

Also advantageously said support means comprises two saddle members for engaging a barrel of said weapon at axially spaced positions along said barrel and said fixing means comprises, for each saddle member, strap fixed to one side of the member and able extend round said barrel to the other side of the saddle member, and toggle clips means for connecting the strap to the other side of the saddle member and for tensioning the straps to clamp the barrel between the strap and the saddle.

BRIEF DESCRIPTION OF THE DRAWINGS

Reference will now be made, by way of example, to the accompanying drawings in which:

FIG. 2 is a cross-sectional view of first pivot joint, part-disassembled, which is used in the mounting assembly of FIG. 1;

FIG. 3 is a part-sectional view of another pivot joint and a clamp which are used in the FIG. 1 assembly;

FIG. 4 is a perspective view of part of the pivot joint of FIG. 3, and;

FIG. 5 is a cross-sectional view of FIg. 4.

DETAILED DESCRIPTION OF THE PREFERRED EMBODIMENTS

Figure 1:
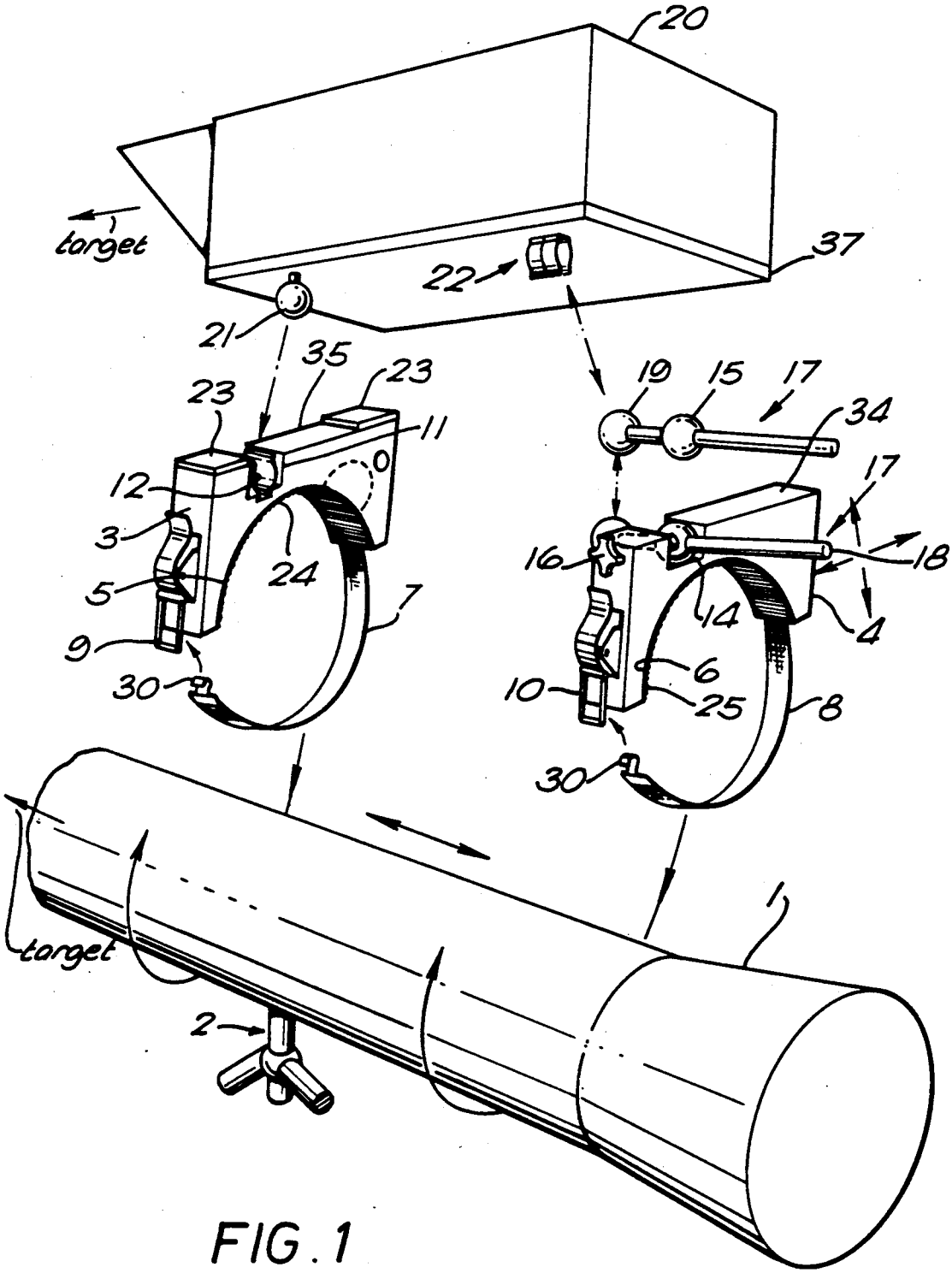
FIG. 1 is a perspective view of part of a weapon and stand therefor, a target sensor, and parts of an assembly for mounting the sensor on the weapon.

In FIG. 1 a weapon, comprising a barrel 1, is shown mounted on a stand 2. Two saddles 3 and 4 are secured to the barrel either before or after initial deployment of the weapon. Saddles 3 and 4 comprise respective arcuate sections 5 and 6 and respective straps 7 and 8. Each strap has one end attached to one side of the associated saddle and its other end terminated by a hook 30 which is engageable with a toggle fastener 9 or 10 attached to the other side of the saddle. The arcuate sections are fitted onto the barrel of the weapon at respective spaced points along its length and are fixed to it by the straps 7 and 8 being engaged round the barrel and tightened and secured by the toggle fasteners 9 and 10.

Saddle 3 further comprises an open rectangular slot 11 which is located in the upper surface 35 of the saddle 3. A 'Terry' tool clip or clips 12 is located within the rectangular slot 11 and is attached by means of screw or rivet 13 to the base of the slot.

Saddle 4 comprises a slot 14 located in the upper surface 34 of the saddle 4. The slot is shown in cross-section in FIG. 3 and comprises a shaped surface 31 (as shown in FIGS. 4 and 5) formed to receive a ball member 15 that may be held clamped by clamp 16 in the slot. Surface 31 is produced by drilling in two directions (A and B) which are orthogonal. The profile at the intersection of the drill paths is substantially in the shape of a crucifix 39. The radius r of the drill paths is slightly less than the radius of ball 13 so that the ball tends to be gripped by the corners 40 of the crucifix. The clamp comprises a part threaded section 36 and unthreaded section 32. Section 32 ends in a substantially dome shaped surface 33 which when the clamp is tightened clamps ball member 15 against surface 31 of the slot 14. Ball member 15 is threaded by a rod, one end of which forms a lever arm 18 and, the other end of which is attached to a another ball member 19. When the clamp is not tightened the ball member 15 may be manoeuvred within the slot 14 by movement of lever arm 18 and may then be reclamped in an different relative position within the slot.

A target sensor 20 in a box shaped housing with a base 37, has attached to its base 37, by any suitable means (not shown), a ball shaped member 21 and a 'Terry' tool clip or clips 22. The relative positions of the ball member 21 and clip 22 on base 37 are such that they may be engaged with respective ones of clip 12 and ball member 19, i.e. so that ball 21 becomes held in slot 11 by clip 12 to form a first ball and socket joint coupling the sensor 20 to the saddle 3, and so that ball member 19 becomes held in 'Terry' clip 22 to form a second ball and socket joint coupling the sensor 20 to the saddle 4.

The mounting directions of 'Terry' clips 12 and 22 are at right angle so that the clip 12 and ball member 21 other restraint axially and ball member 19 and clip 22 offer restraint horizontally when respective ball members are clipped into the respective clips.

A number of compliant pads may be located on saddles 3 and 4 to ease the tolerances of various parts of the assembly. Pads 23 may be located on the upper surface 35 of saddle 3, pad 24 may be located on the arcuate section 5 of saddle 3 and pad 25 may be located on the arcuate section 6 of saddle 4.

In use the weapon is deployed on its stand and in general pointed in the direction of the target. The saddles are attached at predetermined positions along the body of the weapon. The sensor assembly is lowered so that ball member 21 clips into tool clip 12 and ball member 19 clips into clip 22. Once both sets of ball member and clips have been engaged, clamp 16 is released and lever arm 18 may be manoeuvred to facilitate the sensor assembly being in its precise position. (i.e. the sensor is precisely aligned to the potential target). Ball 15 is then reclamped by clamp 16.

It should be noted that prior to deployment the saddle may be pre-assembled to either the weapon or the sensor, in which case the relevant stage is not part of the deployment procedure.

I claim:

1. A mounting assembly for mounting an item onto a weapon, the mounting assembly comprising:

fixing means for fixing a support means to the weapon;

first pivot joint means for coupling the item to the support means to permit turning movement of the item relative to the support means;

second pivot joint means for coupling the support means to a lever to permit turning movement of the lever relative to the support means; and third pivot joint means for coupling the item to the lever to permit said turning movement of the lever relative to the support means to accompany said turning movement of the item relative to the support means.

2. An assembly according to claim 1, further comprising disengageable clamp means for engaging the second pivot joint means to lock the lever with respect to the support means, and thereby also to lock the item with respect to the support means against said turning movement of the item relative to the support means.

3. An assembly according to claim 1, wherein each of said pivot joint means comprises ball and socket joint means for permitting turning movement of the item and the lever about respective associated pairs of transverse axes and for causing turning movement of the lever about either one of the pair of axes associated therewith to be accompanied by turning movement of the item about a corresponding parallel one of the pair of axes associated with the item.

4. An assembly according to claim 3, wherein the first and third pivot joint means each comprise a ball member and a socket formed by one or more spring clips for disengagably holding the ball member.

5. An assembly according to claim 2, wherein each of said pivot joint means comprises ball and socket joint means for permitting turning movement of the item and the lever about respective associated pairs of transverse axes and for causing turning movement of the lever about either one of the pair of axes associated therewith to be accompanied by turning movement of the item about a corresponding parallel one of the pair of axes associated with the item.

6. An assembly according to claim 1, 2, 3, 4, or 5, wherein said support means comprises two saddle members for engaging a barrel of said weapon at axially spaced positions along said barrel, and wherein said fixing means comprises, for each saddle member, a strap fixed to one side of the member and able to extend round said barrel to the other side of the saddle member, and toggle clip means for connecting the straps to the other side of the saddle member and for tensioning the strap to clamp the barrel between the strap and the saddle.

* * * * *